United States Patent [19]

Markham et al.

[11] 4,384,920

[45] May 24, 1983

[54] METHOD AND APPARATUS FOR OXYGEN DELIGNIFICATION

[75] Inventors: Larry D. Markham, Middletown, Ohio; Edward F. Elton, Bethlehem; Vincent L. Magnotta, Coppersburg, both of Pa.

[73] Assignees: The Black Clawson Company, Middletown, Ohio; Air Products and Chemicals Inc., Allentown, Pa.

[21] Appl. No.: 407,203

[22] Filed: Aug. 11, 1982

Related U.S. Application Data

[63] Continuation of Ser. No. 251,401, Apr. 6, 1981, abandoned.

[51] Int. Cl.[3] ..... D21C 7/00; D21C 9/10; D21C 11/06

[52] U.S. Cl. ..... 162/19; 162/37; 162/38; 162/57; 162/65; 162/239; 162/241; 162/243; 422/190; 422/234

[58] Field of Search ..... 162/17, 19, 65, 57, 162/90, 241, 237, 246, 37, 52, 38, 42, 43, 45, 239, 250, 39, 243; 422/190, 234

[56] References Cited

U.S. PATENT DOCUMENTS

| | | | |
|---|---|---|---|
| 3,754,417 | 8/1973 | Jamieson | 162/65 X |
| 3,832,276 | 8/1974 | Roymoulik | 162/65 |
| 3,964,962 | 6/1976 | Carlsmith | 162/65 X |
| 4,050,981 | 9/1977 | Jamieson et al. | 162/65 X |
| 4,093,511 | 6/1978 | Richter | 162/65 X |
| 4,161,421 | 7/1979 | Sherman | 162/18 |
| 4,177,105 | 12/1979 | Laakso et al. | 162/65 |
| 4,248,662 | 2/1981 | Wallick | 162/65 |

FOREIGN PATENT DOCUMENTS

| | | | |
|---|---|---|---|
| 53-09286 | 4/1978 | Japan | 162/65 |

OTHER PUBLICATIONS

Chang et al., "Delignification of High Yield Pulps with Oxygen and Alkali", *TAPPI*, vol. 57, No. 5, May 1974, p. 123.

Annergren et al., "An Alternative to High Consistency Oxygen Bleaching", 1979, Pulp Bleaching Conf., Toronto, Canada, Jun. 11-14, 1979, p. 99.

Nusmar et al., "Medium Consistency Oxygen Bleaching", *TAPPI*, vol. 63, No. 4, Apr. 1980, p. 105.

Myburgh, "Operations of the Enstra Oxygen Bleaching Plant", *TAPPI*, vol. 57, No. 5, May 1974, p. 131.

Hillstrom et al., "Process Concepts for Oxygen Delignification", Svensk Paperstid, vol. 80, pp. 167-170, Apr. 1977.

Luthi et al., "Gas Concentration and Temperature Distribution in Oxygen Delignification", presented at the TAPPI Alkaline Pulping Conference, Washington, D.C., Nov. 7-10, 1977.

Evans et al., "The Kinetics of Low Consistency Oxygen Delignification", *TAPPI*, vol. 62, No. 6, Jun. 1979, pp. 37-39.

*Primary Examiner*—Steve Alvo

*Attorney, Agent, or Firm*—Biebel, French and Nauman

[57] ABSTRACT

An apparatus and process for the oxygen delignification of pulp is provided in which the pulp is transported by means of timing screws in essentially plug flow through one or more substantially horizontal reactor tubes. Oxygen gas is injected into the system at a point adjacent to the pulp inlet and travels concurrently in substantially plug flow with the pulp through the system. In this manner, the pulp is initially exposed to gas of a high oxygen partial pressure while gas vented from the system adjacent the pulp outlet is of low oxygen partial pressure and has a high content of diluent gases. The process and apparatus avoid the formation of gas pockets and hot spots which may adversely affect the pulp. In an alternate embodiment, a countercurrent gas flow process is disclosed. Also provided is a catalytic treatment and recirculation system for the vented gas which permits efficient use of oxygen within the system.

14 Claims, 5 Drawing Figures

METHOD AND APPARATUS FOR OXYGEN DELIGNIFICATION

This is a continuation of application Ser. No. 251,401 filed Apr. 6, 1981, now abandoned.

CROSS-REFERENCE TO RELATED APPLICATIONS

This application is related to U.S. application Ser. No. 099,684, now U.S. Pat. No. 4,363,697, entitled "APPARATUS AND METHOD FOR MEDIUM CONSISTENCY OXYGEN DELIGNIFICATION OF PULP", filed Dec. 3, 1979; this application is also related to U.S. application Ser. No. 005,354, now U.S. Pat. No. 4,245,662 entitled "OXYGEN PULPING WITH RECYCLED LIQUOR", filed Jan. 22, 1979.

BACKGROUND OF THE INVENTION

This invention relates to delignifying pulp in the presence of oxygen, and more particularly to an apparatus and process for the efficient addition, removal, and recycle of oxygen gas in a pulp delignification system.

Oxygen delignification can be carried out on a wide variety of fibrous materials including wood chips and pulp. When carried out on a bleachable grade of pulp, the process is generally referred to as oxygen bleaching. Conventional apparatuses and processes for the oxygen delignification of fibrous material such as cellulosic pulps generally react the materials in a pressurized vertical vessel. One of the problems encountered in oxygen delignification systems is that the partial pressure of oxygen in the vessel is reduced by the presence of air which enters the vessel with the pulp and by other gases which are produced during delignification such as carbon dioxide, carbon monoxide, and hydrocarbon gases. Depending upon the purity of the oxygen gas used, inert gases such as nitrogen and argon may also be introduced along with the oxygen gas into the reaction vessel. The reduced partial pressure of oxygen can have a detrimental effect on delignification resulting not only in a slower reaction rate, but also a reduction in pulp brightness, strength, and other properties. Additionally, the presence of combustible gases such as carbon monoxide and hydrocarbons can be dangerous if their concentration reaches or rises above the lower explosive limit.

One method of increasing the partial pressure of oxygen in the reaction vessel is to increase the operating pressure used for the reaction. However, increased operating pressures require thicker-walled, and therefore more expensive, vessels. Additionally, the danger of gas leakage from the vessel is increased, and the feeding of the pulp into the vessel against this higher pressure becomes more difficult.

Alternatively the partial pressure of oxygen can be increased and the partial pressures of other gases reduced by bleeding gas from the reaction vessel and replacing it with oxygen. However, this procedure increases oxygen usage and removes heat from the vessel. In order to minimize the loss of oxygen resulting from bleeding, it is possible to oxidize catalytically the organic product gases formed during the delignification reaction and recycle at least a portion of the bleed stream back to the reactor vessel while still maintaining the concentration of combustible gases below the lower explosive limit.

Temperature control during oxygen delignification can also be a problem due to the exothermic nature of the reaction. Generally, the pulp must be preheated prior to its entry into the reactor to a temperature sufficiently high to initiate the oxidation reaction. However, once initiated, the heat evolved during the reaction must be controlled to prevent pulp degradation which results from too much heating. This over-heating problem is especially acute for processes designed to generate a large Kappa number decrease (i.e., 30 units or more) in the pulp.

Circulation and cooling of the reactor gas has been used as a method of controlling the temperature within the reactor vessel when operating with high consistency pulp. For example, Hillstrom et al, Svensk Paperstid, Vol. 80, pp. 167–70 (Apr. 10, 1977), teach bleeding gas from the top of a vertical delignification reaction vessel to control the content of carbon monoxide and organic gases therein. The carbon monoxide and organic components of the gas are then catalytically oxidized and the gas cooled and recycled back to the reactor vessel.

Carlsmith, U.S. Pat. No. 3,964,962, teaches withdrawing a portion of gas from a vertical delignification reactor vessel and recycling it back to the upper portion of the reactor. It is taught that the withdrawn gas may be optionally cooled, and the system provides a means to redistribute and control heat within the vessel. Laakso et al, U.S. Pat. No. 4,177,105, teaches a similar gas cooling and recycle system for a vertical delignification reactor vessel. Finally, Luthi et al, in a paper entitled "Gas Concentration and Temperature Distribution in Oxygen Delignification," presented at the 1977 TAPPI Alkaline Pulping Conference, Washington, D.C. Nov. 7–10, 1977, studied both concurrent and countercurrent gas recycle schemes for a vertical oxgen delignification vessel.

However, there are several problems inherent in attempting to control both the partial pressure and temperature of oxygen gas in a conventional vertical delignification reactor. Luthi et al, supra, found that the use of countercurrent gas recirculation to achieve adequate temperature control required large gas flows to avoid undesirable hot spots in the vessel and could result in pulp hang-ups. With respect to concurrent gas recirculation, Luthi et al concluded its use for purposes of temperature control is limited by the compaction of pulp which occurs in the reactor vessel. Additionally, in order for concurrent gas movement to occur at a speed greater than the speed of the pulp, the pulp must be of a high (i.e., 30%) consistency. It is well known, however, that high consistency operation can lead to large temperature increases in the pulp during delignification because of the presence of less dilution water to absorb the heat generated.

Finally, movement of gas through a vertical column of pulp such as is present in conventional high consistency delignification systems may not be uniform. Gas channeling can occur which can lead to hot spots and poor gas distribution in the vessel resulting in pulp degradation and/or an increased danger that combustion will occur. Vertical upflow reactors used for low or medium consistency oxygen delignification, such as those disclosed by Richter, U.S. Pat. No. 4,093,511, Roymoulik, U.S. Pat. No. 3,832,276, and Annergren et al, 1979 Pulp Bleaching Conference, Toronto, Canada, June 11–14, 1979, pages 99–105, are especially susceptible to channeling of gas and pulp up through the reactor leading to nonuniform gas and termperature distribution. The channeling of pulp in this type of system is illustrated by the residence distribution curve for the 10 ton/day pilot system used by Annergren et al which shows a broad range of residence times for pulp in the reactor as well as an actual means residence time substantially less than the theoretical residence time. This channeling problem can be expected to be much worse for a larger diameter commercial size reaction vessel.

Attempts have been made to modify vertical upflow reactors of the type described above to avoid channeling problems. However, the equipment used to accomplish this is extremely complex as shown by Sherman, U.S. Pat. No. 4,161,421. Moreover, these vertical upflow reaction systems have the additional disadvantage of the inability to circulate gas through the reactor for temperature control since the gas is present as a dispersed phase and travels upwardly at the same speed as the pulp. Jamieson, U.S. Pat. No. 3,754,417, has suggested other reactor designs for oxygen delignification at low pulp consistency. However, those systems also have serious channeling problems and require large inputs of heat because of the low consistency operation.

Accordingly, the need exists in the art for an improved means of supply and recirculation of gas in an oxygen delignification system. The need is especially acute for those systems in which large amounts of delignification are desired since the amount of heat and quantity of combustible and diluent gases generated will be large.

SUMMARY OF THE INVENTION

In accordance with the present invention, an oxygen delignification system is provided using one or more substantially horizontal tubes having internal screws for pulp transport as the oxygen reactor. Oxygen gas is introduced into the system at a point adjacent the pulp inlet and moves in essentially plug flow in the same direction as the pulp through the system. Bleed gas can be removed from the system at a point adjacent to the pulp outlet.

A gas space if maintained at the top of each tube during the delignification reaction so that free movement of gas in essentially plug flow is achieved. The speed of the internal screws controls the retention time of the pulp in the reactor and insures that the pulp moves in plug flow. In order to insure the free movement of gas at a speed different from the speed of the pulp, it is essential that the pulp level must be no more than 90% of the total tube volume. The gas will be moving substantially faster near the pulp inlet than near the pulp outlet because of the high rate of oxygen consumption at the start of the reaction, and this gas movement flushes the nitrogen and combustible gases towards the discharge end of the system. The gas which is trapped within the pulp is exchanged with the free gas above the pulp as a result of the action of the conveying screw, which continuously lifts and turns over the pulp mass in the tube.

In this manner, the continuous movement of gas from the inlet to the outlet of the reactor and the exchange of free gas and trapped gas prevents the formation of pockets of gas which have a higher content of potentially explosive gases or a lower content of oxygen. Similarly, a temperature equilibrium is maintained so that hot spots cannot develop.

Since pure oxygen is introduced near the pulp inlet, the pulp is exposed to the highest partial pressure of oxygen during the initial stages of the reaction where delignification is the most rapid and oxygen consumption is the greatest. As the pulp is advanced by the internal screws, more oxygen is consumed and more reaction product gases such as carbon dioxide, carbon monoxide, and hydrocarbons are generated. The content of carbon dioxide in the gas phase increases not only due to the delignification reaction, but also because as the pH of the alkaline reaction liquor decreases as delignification proceeds, carbonate and bicarbonate ions in the liquor can decompose into free carbon dioxide gas.

As the delignified pulp approaches the discharge point at the end of the reactor, the partial pressure of oxygen is at its minimum value while the partial pressure of other gases present in the system is at a maximum. Thus, the gas which is lost from the system on discharge with the delignified pulp is the gas of lowest oxygen content. Moreover, the practice of the present invention optionally provides for bleeding of the gas from the system at a point adjacent the pulp discharge outlet. This bleeding removes from the reactor the gas having the maximum content of non-oxygen gases including potentially explosive gases such as carbon monoxide and hydrocarbons. When relatively small amounts of delignification are desired, bleeding may not be necessary.

The process of the present invention is applicable to the oxygen delignification of all types of cellulosic materials including wood chips, bagasse, straw, other agricultural materials, ground wood, thermomechanical pulp, chemimechanical pulp, semichemical pulp, rejects and knots from a pulping process, and chemical pulps such as Kraft, soda, and sulfite pulps. The consistency of raw material introduced into the reactor may be from 1% to 35%, and preferably from 8% to 20%.

The alkaline liquor used in the delignification reaction may be known alkaline materials used in the art including sodium hydroxide, sodium carbonate, sodium bicarbonate, ammonia, Kraft white liquor, oxidized Kraft white liquor, green liquor, sodium tetraborate, sodium metaborate, and mixtures thereof. The dosage of alkaline material on the raw material may be varied over a wide range and is generally in the range of from 0.5% to 30% calculated as $Na_2O$ on oven dry raw material. Known protector chemicals such as magnesium compounds can be used if desired to preserve the viscosity and strength of the pulp. The temperature and pressure and retention time used for the delignification reaction can similarly be varied over a wide range. It has been found that temperatures of from 80°–160° C. and an oxygen partial pressure of from 20–300 psig and retention times of 5–120 minutes will produce suitable delignification.

In an alternate embodiment of the invention, a countercurrent flow of oxygen gas through the reactor may be utilized by injecting gas at a point near the discharge outlet of the reactor. Because of the plug flow characteristics of the gas in both the cocurrent and countercurrent modes of operation, the formation of hot spots and potentially dangerous pockets of gas is eliminated.

In another embodiment of the invention, gas can be bled off and recirculated to each individual tube to achieve precise control of the reaction conditions in each tube. Thus, the recirculated gas can be cooled or not as required and can be passed over a catalyst bed to oxidize combustible components thereof prior to its return to a reactor tube. For example, in a three tube system it may be desirable to pass any gas bled from the second tube through a cooler before reintroducing it in order to control the heat from the exothermic delignification reaction. Moreover, the concentration of combustible gases would be at a maximum in the third tube so that it would be desirable to circulate that gas through a catalyst bed prior to its recycle back into the third tube. Other modifications will be appreciated by those skilled in the art to adapt the system to various degrees of delignification.

Accordingly, it is an object of the present invention to provide a delignification system which will both rapidly and uniformly delignify pulp and the like, efficiently supply and utilize oxygen gas attain uniform temperature control of the reaction, and avoid the formation of hot spots and gas pockets. This and other objects and advantages of the invention will become apparent from the following description, the accompanying drawings, and the appended claims.

DESCRIPTION OF THE PREFERRED EMBODIMENTS

Figure 1:
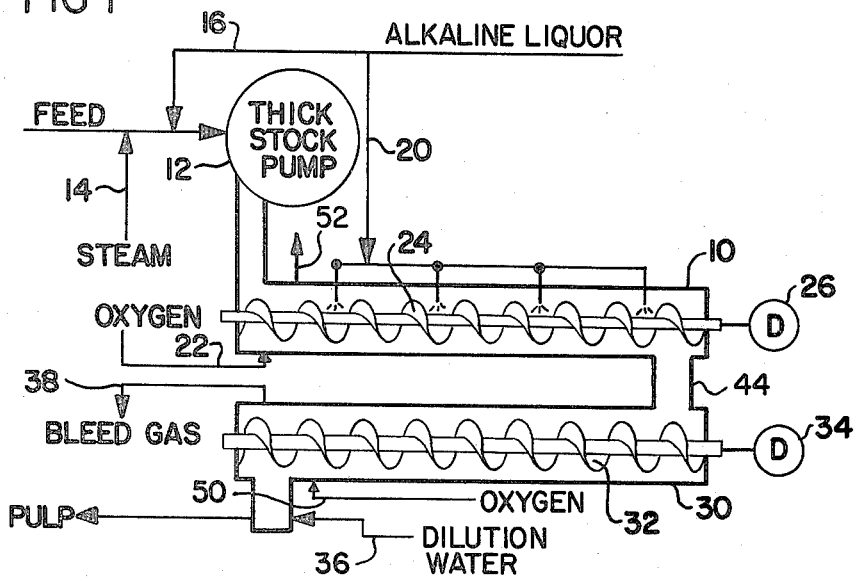
FIG. 1 is a schematic flow diagram illustrating the process of the present invention.

As illustrated in FIG. 1, pulp at from 1.0% to 35% consistency, and preferably 8% to 20% consistency, is introduced into a first substantially horizontal reaction tube 10 by thick stock pump 12. The use of substantially horizontal tubes includes the use of inclined tubes. However, the angle of incline should not exceed approximately 45 degrees to avoid compression and dewatering of the pulp in the lower end of the tube which will interfere with the uniform mixing of oxygen. Additionally, while the reaction vessel is illustrated as a series of substantially cylindrical reactor tubes, a single vessel having a series of reaction zones or noncylindrical tubes such as a twin screw system may be utilized.

Pump 12 may be a Moyno progressing cavity pump available from Robbins & Myers, Inc., Springfield, Ohio. Alternatively, pump 12 may be a Cloverotor pump available from the Impco Division of Ingersoll-Rand Co., Nashua, N.H., or a thick stock pump manufactured by Warren Pumps, Inc., Warren, Mass.

It has been found that these pumps are capable of feeding the pulp into the reaction tube against the pressure in that tube without severely compacting the pulp and without any gas losses from the tube. Other feeding devices such as rotary valves or screw feeders are not desirable for use in this invention. A rotary valve allows substantial gas loss from the reaction tube due to the rotation of valve sections which are alternately exposed to the high oxygen pressure in the reactor and then to atmospheric pressure external to the reactor. Use of a screw feeder results in the severe compression and dewatering of pulp so that efficient oxygenation at the proper consistency range cannot occur.

Prior to introducing the pulp into thick stock pump 12, steam may be injected into the pulp via line 14. The steam aids in expelling excess air from the pulp and also raises the temperature of the pulp somewhat. Additionally, it is desirable to add at least a portion of the total amount of the charge of alkaline material prior to the introduction of the pulp into thick stock pump 12. This addition of alkaline material can be made through line 16. The alkaline material serves to lubricate the pulp for easier pumping as well as to insure that the pulp will have an alkaline pH when it enters reaction tube 10. Alternatively, all of the charge may be added at this point.

Generally, the total alkaline material charge will amount to from 0.5 to 30% by weight calculated as $Na_2O$ of the oven dry weight of the raw fibrous material. Examples of alkaline materials suitable for use in this invention include sodium hydroxide, sodium carbonate, sodium bicarbonate, ammonia, oxidized Kraft white liquor, green liquor, sodium tetraborate, sodium metaborate, and mixtures thereof. Other known alkaline pulping liquors may also be used. The temperatures and pressures used for the delignification reaction can similarly be varied over a wide range. It has been found that temperatures of from 80°–160° C., an oxygen partial pressure of from 20–300 psig and retention times of 5–120 minutes will produce a suitable level of delignification.

The other portion of alkaline liquor is injected through line 20 and sprayed over the pulp along the length of the tube. By adding the alkaline liquor gradually along the length of the tube rather than all at once as is conventional in high consistency (i.e., 20–35% consistency) oxygen delignification, better pulp viscosity and strength is achieved. Another advantage to adding the alkaline liquor gradually is that the exothermic delignification reaction is more easily controlled, and the risk of localized overheating is diminished.

Oxygen gas is added to the system at a point adjacent the pulp inlet through line 22 where it is mixed with the pulp and alkaline liquor. By "adjacent the pulp inlet", it is meant that oxygen is added to the system prior to midway along the length of the reactor tube. Preferably, the oxygen gas is of high purity (i.e., typically 95% purity) although lower purity oxygen can also be used. Preferably, the oxygen is injected at or near the base of reaction tube 10. Mixing and transport of the pulp and alkaline liquor is achieved by rotating timing screw 24 by a suitable drive means 26. Screw 24 can be of a design conventional in the art, for example, a solid helical flight design. The speed of rotation of screw 24 can be varied to control the retention time of the pulp in the reactor and insures that the pulp is transported forward in essentially plug flow.

A gas space is maintained at the top of reaction tube 10 so that the oxygen gas can freely move forward in plug flow at a speed different from the speed of the pulp. It has been found that operation of the system with the reaction tubes less than full and preferably from 50–90% filled, produces acceptable results. The achievement of plug flow is especially important during the initial stages of delignification to insure that the pulp of highest lignin content is exposed to the gas of highest oxygen content. The continuous movement of gas and pulp along the length of the reaction tube and the exchange between gas trapped in the pulp and free gas above the pulp prevents the formation of hot spots or pockets of potentially explosive gases and enhances the uniform delignification of the pulp. It has been found that maintaining an oxygen partial pressure of from between 20 and 300 psig results in an acceptable level of delignification.

After traversing the length of reaction tube 10, the pulp, oxygen, and alkaline liquor mixture is introduced into one or more subsequent substantially horizontal reaction tubes such as reaction tube 30. An internal timing screw 32 driven by suitable drive means 34 continuously mixes and transports the mixture along the length of the reaction tube. Again, the speed of rotation of the timing screw can be varied to control the retention time and the level of the pulp and allow for adequate delignification. Further reaction tubes (not shown) may be utilized if necessary.

As the delignified pulp approaches the discharge point at the end of reaction tube, 30, the partial pressure of oxygen is at its minimum while the partial pressures of reaction product gases such as carbon dioxide, carbon monoxide, and hydrocarbons are at a maximum. The pulp is withdrawn from reaction tube 30 and passed to a cold blow region where it is contacted with dilution water or liquor from line 36. Gas may optionally be vented from the system through line 38 at a point adjacent the discharge outlet of reaction tube 30. In this manner, gas having the least amount of oxygen and the greatest amount of diluent gases is discharged from the system.

Figure 2:
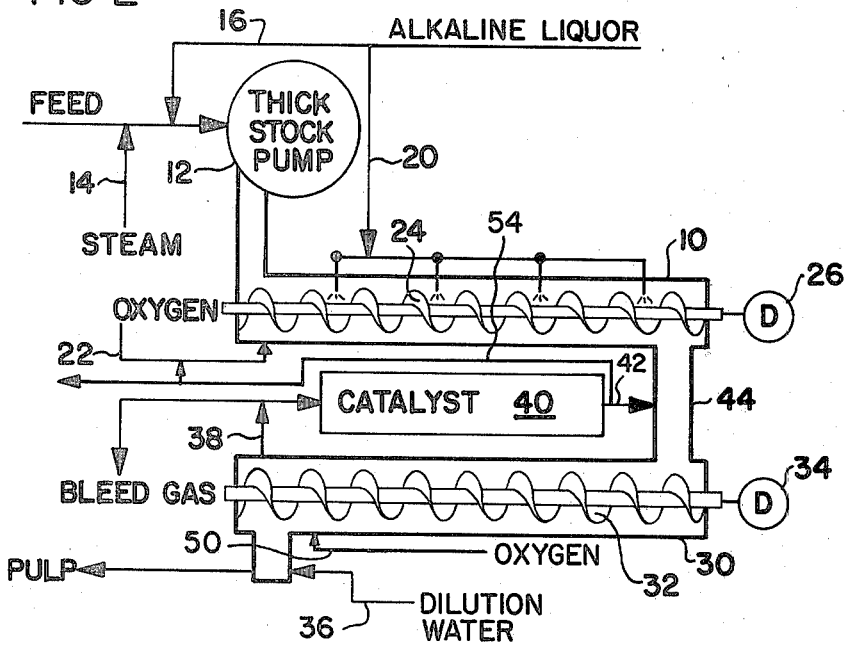
FIG. 2 is a schematic flow diagram illustrating another embodiment of the present invention.
Figure 3:
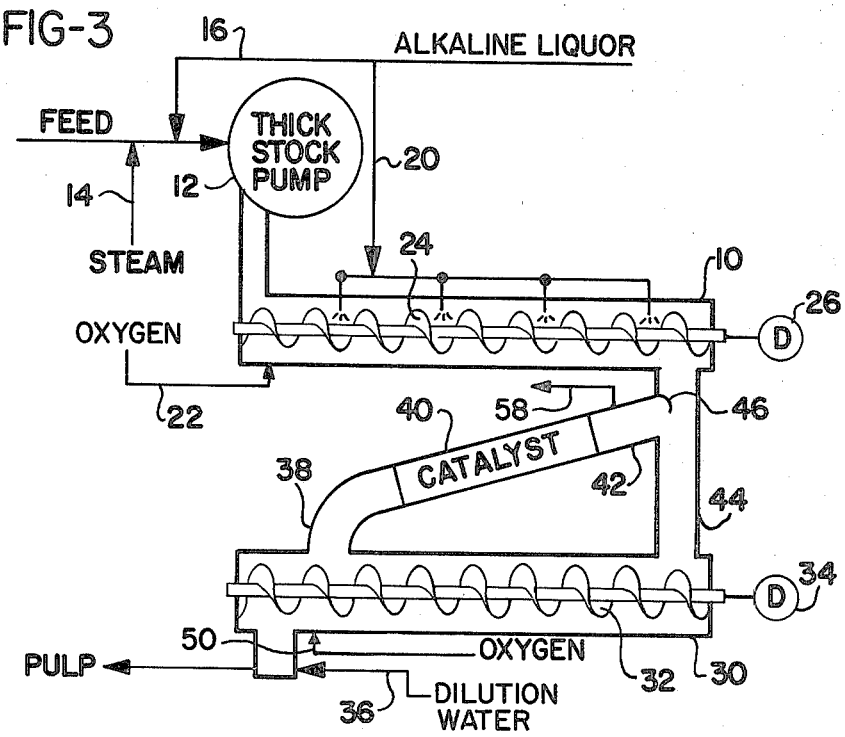
FIG. 3 is a schematic flow diagram of yet another embodiment of the present invention.

In an alternate embodiment of the invention, a countercurrent flow of oxygen gas through the reactor tubes can be utilized. As shown in FIGS. 1–3, an inlet 50, located at the base of reaction tube 30 near its discharge outlet, can be used to inject oxygen gas into the system. The gas will flow in plug flow through the reaction tubes, but in the opposite direction from the direction of pulp flow. This countercurrent flow mode of operation produces both acceptable delignification and good pulp viscosity while avoiding the formation of hot spots and gas pockets. A gas vent 52 may be provided near the pulp inlet to reaction tube 10 to bleed gases.

In another embodiment of the invention using cocurrent gas flow illustrated in FIG. 2, where like reference numerals represent like elements, at least a portion of the gases vented from tube 30 through line 38 is sent through a catalyst bed 40. Catalyst bed 40 acts to oxidize carbon monoxide and other potentially explosive hydrocarbon gases produced as a result of the delignification reaction. The treated gases, which contain oxygen as well as carbon dioxide, are then recirculated to tube 30 via line 42 which is in fluid communication with conduit 44. Gases may be vented through vent 54 or may be recirculated back to inlet 22 as shown. If the delignification system comprises a multiplicity of reaction tubes, gas from each tube may be catalytically treated and recirculated to the same or other tubes. Alternatively, simultaneous cocurrent and countercurrent gas flow schemes are contemplated in which oxygen is supplied at or near the midpoint of a reaction tube or series of tubes. Other possible arrangements will be apparent to those skilled in this art including treatment and recirculation of gas flowing countercurrently to the direction of pulp flow.

In the embodiment illustrated in FIG. 3, where like reference numerals represent like elements, the natural draft created by pulp falling through vertical conduit 44 between tubes 10 and 30 is utilized to draw gas vented from tube 30 through catalyst bed 40. Since heat is generated by the catalytic reaction, the heated gas will tend to rise. Thus, gas recirculation lines 38 and 42 as well as catalyst bed 40 are inclined upwardly to aid in the natural recirculation effect. A baffle 46, or other suitable means, prevents pulp from entering conduit 42. Alternatively, a steam ejector or other conventional method may be used to recirculate the treated gas. A vent tube 58 may be provided downstream of the catalyst bed to serve as a means to purge carbon dioxide and inert gases from the apparatus.

The invention may be better understood by reference to the following nonlimiting examples.

EXAMPLE 1

A softwood thermomechanical pulp was delignified with oxygen and alkali at 8% pulp consistency and 160° C. The total reaction time was 60 minutes and an alkali dosage of 30% sodium carbonate was used on the pulp. The reactor was a horizontal tubular vessel having a horizontal shaft therethrough equipped with paddle flights and rotated at a low speed. The partial pressure of steam at the reaction temperature was 75 psig. To simulate cocurrent oxygen gas flow, in Run 1A the partial pressure of oxygen in the reactor was gradually reduced from 125 psig at the start of the reaction to 75 psig at the end of the reaction. Countercurrent gas flow was simulated in Run 1B by increasing the partial pressure of oxygen from 75 psig at the start of the reaction to 125 psig at the end of the reaction.

The results of the tests are reported below:

| Run | Kappa No. | % Pulp Yield | Brightness |
|---|---|---|---|
| 1A | 121 | 70.3 | 15 |
| 1B | 136 | 70.6 | 12 |

While Run 1A, which simulated cocurrent gas flow, had a faster delignification rate, a more selective delignification (as shown by substantially equal pulp yield at a lower Kappa number), and a higher brightness compared to Run 1B, Run 1B illustrates that a countercurrent oxygen gas flow scheme in a horizontal tubular reactor will produce satisfactory delignification.

EXAMPLE 2

A softwood sulfite pulp having an initial Kappa number of 69.2 was delignified in the reactor described in Example 1 with oxygen and alkali for a total reaction time of 20 minutes. The consistency of the pulp was 15%, the reaction temperature was 120° C., and the sodium hydroxide dosage was 5.0% by weight based on oven dry pulp. In Run 2A, the partial pressure of oxygen was gradually reduced from 66 psig at the start of the reaction of 36 psig at the end of the 20 minute reaction period. In Run 2B, the partial pressure of oxygen was gradually increased from 36 psig at the start of the reaction to 66 psig at the end of the reaction time. In both runs the partial pressure of steam in the reactor was maintained at 14 psig throughout the reaction period.

The results of the tests are reported below:

| Run | Kappa No. | % Delignification | % Pulp Yield | Brightness |
|---|---|---|---|---|
| 2A | 40.2 | 41.9 | 85.5 | 37 |
| 2B | 43.4 | 37.3 | 85.2 | 35 |

It is evident that Run 2A which simulated a cocurrent oxygen gas flow had a faster delignification rate (i.e., lower Kappa number), a higher pulp brightness, and a greater selectivity than Run 2B which simulated a countercurrent gas flow. However, the results reported for Run 2B indicate that satisfactory delignification is obtained for a countercurrent oxygen gas flow scheme in a horizontal tubular reactor.

EXAMPLE 3

Several tests were performed in a three tube continuous horizontal tubular reactor using a countercurrent oxygen gas flow scheme. Each tube was equipped with a horizontal screw which was turned at low speed to advance the pulp. Oxygen was introduced into the reactor near the discharge end of the third tube producing a gas flow countercurrent to the direction of flow of pulp. The tests were made with a 10% pulp consistency, a 3% sodium hydroxide dosage, 100 psig total pressure, and with a pulp having an initial Kappa number of 29.3. The pulp level in the reaction tubes was maintained at a maximum of 55% of the total tube volume. Retention times were varied from 8 to 39 minutes and production rates were varied from 1.7 to 5.0 ton/day.

Figure 4:
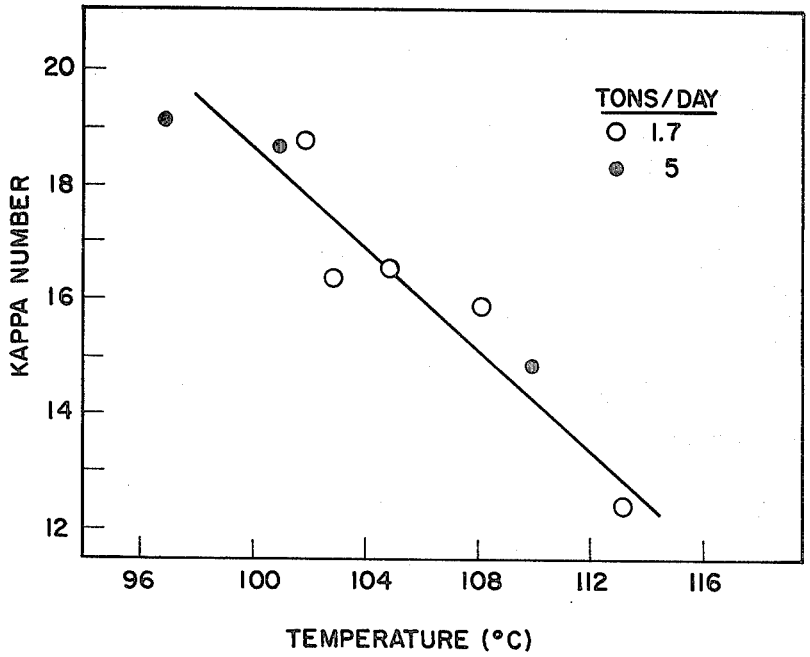
FIG. 4 is a graph of temperature versus final Kappa number of pulp.
Figure 5:
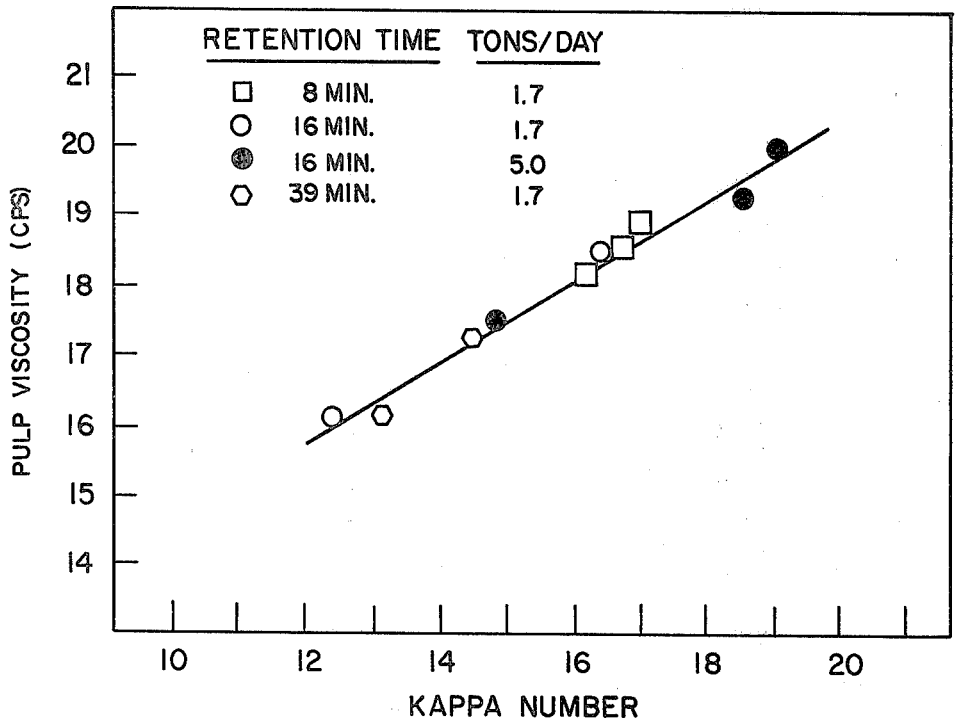
FIG. 5 is a graph of Kappa number versus pulp viscosity.

The results of the tests are shown in FIGS. 4 and 5.

The results of the tests show a rapid delignification rate and a high pulp viscosity (indicative of good strength properties) over a wide range of retention times and production rates. The pulp viscosity was excellent even when degree of delignification approached 60%. The results shown that oxygen contact with the pulp was good even though only one gas inlet was used in this multiple tube reactor and even though the tests were run at a medium pulp consistency. This is the most difficult consistency range in which to achieve good oxygen contact since the pulp is present as sticky lumps.

While the described apparatus and methods constitute preferred embodiments of the invention, it is to be understood that the invention is not limited to these precise apparatus and methods, and that changes may be made in either without departing from the scope of the invention, which is defined in the appended claims.

What is claimed is:

1. A process for the continuous oxygen delignification of pulp comprising the steps of introducing pulp at from 8–20% consistency and alkaline chemicals into a substantially horizontal tubular reaction zone while maintaining a gas space at the top of said reaction zone, adding oxygen gas into said zone at a point adjacent the introduction of said pulp, said oxygen gas moving freely through said reaction zone in substantially plug flow, continuously mixing and transporting the mixture of pulp and alkaline chemicals along the entire length of said reaction zone in substantially plug flow concurrently with said oxygen gas in said gas space through the reaction zone, the pulp level in said reaction zone being no more than 90% of the total volume of said reaction zone and removing the delignified pulp through an outlet in said zone.

2. The process of claim 1 including the step of withdrawing gas containing delignification reaction product gases from a point adjacent said outlet.

3. A process for the continuous oxygen delignification of pulp comprising the steps of introducing pulp at from 8–20% consistency and alkaline chemicals into a first substantially horizontal tubular reaction zone while maintaining a gas space at the top of said reaction zone, adding oxygen gas into said first zone at a point adjacent the introduction of said pulp, said oxygen gas moving freely through said first reaction zone is substantially plug flow, continuously mixing and transporting the mixture of pulp and alkaline chemicals along the entire length of said first reacton zone in substantially plug flow concurrently with said oxygen gas in said gas space through said first reaction zone, the pulp level in said reaction zone being no more than 90% of the total volume of said first reaction zone, transferring said mixture into one of more subsequent substantially horizontal, tubular reaction zones, transporting the mixture of pulp and alkaline chemicals in substatially plug flow concurrently with said oxygen gas through said one or more subsequent zones, and removing delignified pulp through an outlet in the last of said one or more subsequent zones.

4. The process of claim 3 including the step of withdrawing gas containing reaction product gases from a point adjacent said outlet.

5. The process of claim 4 including the steps of catalytically oxidizing the potentially combustible reaction product gases withdrawn from the last reaction zone and recirculating the withdrawn gas to a point adjacent the inlet of the last of said one or more subsequent reaction zones.

6. The process of claim 4 including the steps of cooling the gas withdrawn from the last reacton zone and recirculating the cooled gas to a point adjacent the inlet of the last of said one or more subsequent reaction zones.

7. The process of claim 4 including the steps of withdrawing gas containing reaction product gases from points adjacent the outlets of each of said one or more subsequent reaction zones, catalytically oxidizing the potentially combustible reaction product gases withdrawn from each of said zones, and recirculating the withdrawn gas to points adjacent the respective inlets of each of said one or more subsequent reaction zones.

8. The process of claim 4 including the steps of cooling the gas withdrawn from points adjacent the outlets of each of said one or more subsequent reaction zones and recirculating the cooled gas to points adjacent the respective inlets of each of said one or more subsequent reaction zones.

9. The process of claim 5 including the step of cooling the gas withdrawn from said last reaction zone prior to recirculating it.

10. The process of claim 7 including the step of cooling the gases withdrawn from each of said one or more subsequent reaction zones prior to recirculating them.

11. A process for the continuous oxygen delignification of pulp comprising the steps of introducing pulp at from 8–20% consistency and alkaline chemicals into a first end of a substantially horizontal tubular reaction zone while maintaining a gas space at the top of said reaction zone, adding oxygen gas into said reaction zone at the opposite end of said reaction zone, said oxygen gas moving freely through said reaction zone in substantially plug flow, continuously mixing and transporting the mixture of pulp and alkaline chemicals along the entire length of said reaction zone in substantially plug flow countercurrently to the direction of flow of said oxygen as in said gas space through the reaction zone, the pulp level in said reaction zone being no more than 90% of the total volume of said reaction zone, and removing the delignified pulp through an outlet at said opposite end of said zone.

12. The process of claim 11 including the step of withdrawing gas containing delignification reaction product gases from a point adjacent said first end of said zone.

13. A process for the continuous oxygen delignification of pulp comprising the steps of introducing pulp at from 8–20% consistency and alkaline chemicals into a first end of a substantially horizontal tubular reaction zone while maintaining a gas space at the top of said reaction zone, adding oxygen gas into said zone, said oxygen gas moving freely through said reaction zone in substantially plug flow, continuously mixing and transporting the mixture of pulp and alkaline chemicals along the entire length of said reaction zone in substantially plug flow from said first end of said reaction zone to the opposite end thereof, directing a first portion of said oxygen gas to flow in said gas space substantially concurrently with the direction of flow of said mixture while directing a second portion of said oxygen gas to flow in said gas space countercurrently to the direction of flow of said mixture, the pulp level in said reaction zone being no more than 90% of the total volume of said reaction zone, and removing the delignified pulp through an outlet at said opposite end of said zone.

14. Apparatus for continuous oxygen delignification of pulp comprising in combination:

(a) a first substantially horizontal, tubular reaction vessel having an inlet and an outlet, (b) means for introducing pulp at from 8–20% consistency at said inlet at a first end of said first reaction vessel while maintaining a gas space at the top of said vessel, (c) means for introducing oxygen gas into said reaction vessel at at least one point adjacent to said means for introducing pulp for concurrent flow of said gas in said gas space with said pulp, (d) means in said reaction vessel for transporting pulp from said first end of said reaction vessel to the opposite end thereof, (e) means for withdrawing delignified pulp from said outlet at said opposite end of said first reaction vessel, (f) a second, substantially horizontal, tubular reaction vessel having an inlet and an outlet, said inlet in fluid communication with the outlet of said first reacton vessel, (g) said second tubular reaction vessel including means for transferring pulp to a first end of said second reaction vessel through said inlet, (h) means in said second reaction vessel for transporting said pulp from said first end of said reaction vessel to the outlet at the opposite end thereof, (i) means for withdrawing delignified pulp from the outlet at said opposite end of said second reaction vessel, (j) means in said second reaction vessel for withdrawing gas containing reaction product gases at a point adjacent said opposite end of said second reaction vessel, (k) means for recirculating the withdrawn gas to said first end of said second reaction vessel, said recirculating means including a generally upwardly inclined conduit means connecting said means for withdrawing gas with said outlet of said first reaction vessel, said recirculating means further including means for catalytically oxidizing potentially combustible reaction gases.

* * * * *